United States Patent [19]

Watanabe et al.

[11] 4,216,055

[45] Aug. 5, 1980

[54] ELECTROSTATIC RECORDING MATERIAL AND THE METHOD OF PREPARING IT

[75] Inventors: Noritoshi Watanabe; Riyozo Yamamoto; Isao Shoji; Hisanori Yagi, all of Hyogo, Japan

[73] Assignee: Kanzaki Paper Manufacturing Co., Ltd., Tokyo, Japan

[21] Appl. No.: 945,340

[22] Filed: Sep. 25, 1978

Related U.S. Application Data

[63] Continuation of Ser. No. 750,407, Dec. 14, 1976, abandoned.

[30] Foreign Application Priority Data

Dec. 25, 1975 [JP] Japan ..... 50-158187

[51] Int. Cl.[2] ..... D21H 5/00

[52] U.S. Cl. ..... 162/117; 162/135; 162/146; 162/206; 427/121; 427/161

[58] Field of Search ..... 162/136, 138, 146, 206, 162/117, 135; 264/175, 284; 427/161, 121; 29/121.8; 428/342

[56] References Cited

U.S. PATENT DOCUMENTS 4,015,043 3/1977 Watanabe ..... 162/146

FOREIGN PATENT DOCUMENTS 45-5326 3/1969 Japan .

*Primary Examiner*—William F. Smith

*Attorney, Agent, or Firm*—Armstrong, Nikaido, Marmelstein & Kubovcik

[57] ABSTRACT

The electrostatic recording material comprises an electroconductive transparent base sheet having a dielectric layer thereon. The base sheet is obtained by moistening a paper prepared from relatively lightly beaten pulp and then subjecting the moistened paper to a calendering treatment with the use of a heated embossing metal roll having a finely engraved surface with sharp reliefs.

12 Claims, No Drawings

ELECTROSTATIC RECORDING MATERIAL AND THE METHOD OF PREPARING IT

This is a continuation of application Ser. No. 750,407, filed Dec. 14, 1976 abandoned.

BACKGROUND OF THE INVENTION

This invention relates to an improved electrostatic recording material, particularly to an electrostatic recording material which comprises an electroconductive transparentized base sheet having a finely embossed surface and a dielectric layer thereon.

The electrostatic recording system has recently been widely applied to a facsimile or a computer input-output system suitable for high speed recording in a high speed telecommunication system, a high speed graphic reproduction system, etc. The electrostatic recording material as a recording medium basically comprises a highly dielectric layer, which serves as an electric-charge-retentive layer, and an electroconductive base sheet which supports the dielectric layer. Electrostatic images of electrical signals formed on the dielectric layer are made visible with a developer comprising a toner and a carrier which has a polarity opposite to the polarity of the electrostatic image charge, and fixed as permanent visible images by further treatment.

The electrostatic recording system does not involve any photoelectric conversion in the process of forming electrostatic latent images on the dielectric layer. The electrostatic recording material of the invention, therefore, does not include any so-called photosensitive element.

There have been proposed various methods for forming electrostatic latent images on a dielectric layer. Among them there are a method of imparting electric signals on the dielectric layer by making it contact with an electroconductive material such as a metal; a method of transforming electrostatic latent images formed on the other medium to the electrostatic recording material, which is known as the "TEST" method and disclosed, for example, in PHOTOGRAPHIC SCIENCE AND ENGINEERING, Vol. 9, No. 1, January–February 1965; and a method of forming discharged patterns on the surface of the recording material with use of a photoconductive film as a switching element, which is known as the "WALCUP" method and disclosed, for example, in U.S. Pat. No. 2,833,930. The electrostatic recording material described can be used in any of those methods for forming electrostatic latent images.

The electrostatic recording system described, however, is distinct from the system for forming latent images by photoelectric conversion with the utilization of a photosensitive material in the recording sheet. In the electrostatic recording system, it is very difficult to obtain multiple reproductions at one time. Therefore, the recorded electrostatic recording material is often used as a master copy for obtaining further multiple copies. In another case, a multiplicity of the electrostatic recording papers recorded with a facsimile or printer plotter are piled and used as a so-called overlay paper. To prepare the electrostatic recording material which is used for those purposes, commercially available tracing papers of glassine papers have been generally used as base sheets. However, such conventional base sheets involve some fatal disadvantages when used for the electrostatic recording material.

To obtain tracing paper or glassine paper having a desired transparency, beating of pulp must be carried out to an utmost extent until cellulose fibers are extremely fibrillated. Consequently, the fibers are injured to impair the paper making property and the physical strength of the paper obtained is unsatisfactory. In addition, since many hydroxyl groups which are sensitive to moisture or water are exposed on the surfaces of the fibers as a result of a high fibrillation, the paper becomes well absorptive of water and accordingly the dimensional stability of the paper is extremely degraded. Owing to those disadvantages, the workabilities for coating and processing in the manufacturing of the electrostatic recording material are significantly lowered. Moreover, the electrostatic recording material produced with use of the above conventional base sheet tends to curl by a change in moisture of the atmosphere or in contact with water and tends to be brittle during the process of fixing treatment with heat. These also lead to make difficult to handle and lower the workability. The above conventional tracing papers and glassine papers further have such a disadvantage that the adsorbed water which is combined with hydroxyl groups is vaporized and expanded to form bubbles in the paper when it is heated, which is the so-called blister phenomenon.

In the electrostatic recording material, a physical or geometrical figure of the surface of the recording material other than the electrical function constitutes an important factor in the recordability. For example, the geometrical uneven surface structure of the dielectric layer has an intimate relationship with a threshold voltage, and a proper roughness of the surface contributes to enhancing a voltage sensitivity and a recordability of the electrostatic recording material. In addition, the geometrical surface structure bears relationships with a writability of the dielectric layer, a fixing ability of toner, a blocking resistance and a slipping property (friction coefficient).

In order to prepare the improved electrostatic recording material, there have been made various attempts, in which almost attention has been given to the improvement of dielectric layer itself. There has never been any attempt to improve the base sheet. For example, there has been proposed a method in which the granular materials (spacer pigment) having a proper diameter are added to the dielectric layer. However, the addition of the particulate materials leads to a degradation of electrical characteristics such as an insulation resistance and a dielectric property at a high humidity, and it makes the process troublesome. Since the electrostatic recording material is partially equivalent to a condenser, an allowable deviation of the thickness of the dielectric layer should be limited to a narrow range. However, the dielectric layer is formed generally with the use of conventional coating devices such as a roll coater, an air knife coater and a blade coater as well as on making a usual coater paper, so it is very difficult to obtain a uniform dielectric layer with a required accuracy. There are two leading factors affecting the accuracy in the above methods. One of them is a fluidity of coating composition, and another is a surface condition of the base sheet. Since the coating composition has a fluidity upon the coating procedure, it is affected by the surface condition of the base sheet and by the kinetic characteristic of coating composition until the coating composition is set on the surface of base sheet. Accordingly, when a paper having a very smooth surfaces land excessive water absorption resistance such as a glassine paper is used as a base sheet for the electrostatic recording material, it is very difficult to form a uniform dielectric layer on it.

According to the invention, the above described problems in the prior arts can be solved. This invention is based on a discovery which is against the heretofore accepted theory that a heavy beating is required for obtaining a desired transparency of the base sheet. This invention is characterized by using the ordinarily or lightly beaten pulp which is used for forming general paper, and by subjeting the resultant paper to heat and pressure with the use of a special embossing metal roll, whereby the disadvantages, i.e. decrease in transparency, inherent in the use of such lightly beaten pulp can be avoided.

An object of the invention is to provide an improved electrostatic recording material having an excellent balance in quality and to provide a process for making it.

Other objects and advantages of the invention will become apparent from the following descriptions.

SUMMARY OF THE INVENTION

The electrostatic recording material according to the invention comprises a transparent electroconductive base sheet having a dielectric layer thereon. The base sheet is obtained by preparing a paper from an aqueous suspension of pulp having a Canadian Standard Freeness (hereinafter referred to as CSF) larger than 100 cc which is composed of natural pulp alone or a mixture of natural pulp and synthetic pulp, moistening the paper so as to have a moisture content within the range of 5% to 30% and then subjecting the moistened paper to a calendering treatment with the use of heated embossing metal roll to transparentize it and form a finely embossed surface thereon. The embossing metal roll has a peripheral surface engraved so as to have a surface roughness of a Rmax of 5 to 200 microns and a relief peak number of 1 to 20 per 1 mm.

DETAILED DESCRIPTION OF THE INVENTION

In this invention, it is an essential requirement that the paper used in the invention should be prepared from an aqueous suspension of pulp whose beating degree is larger than 100 cc in CSF and which contains natural pulp alone or a mixture of natural pulp and synthetic pulp. The term of beating degree means that of the pulp suspension in the prior state to paper making. Among the pulp suspension there are included a suspension of beaten virgin pulp, a suspension of disintegrated pulp from waste papers and a mixture thereof. In addition, even if pulp itself has a beating degree out of the range defined in the invention, it may be used provided that the beating degree falls within the range defined upon mixing it with other pulp.

Among the pulp suspensions having beating degree of the specific range described above, that having the beating degree of 150 to 650 cc in CSF is preferable and that having the beating degree of 200 to 600 cc in CSF is the most preferable.

As natural pulp, any kind of natural pulp available for a wet paper making such as wood pulp and the other natural pulp, for example, those prepared from bast fibers, cotton fibers, animal fibers and the like may be used. Among them the wood pulp is the most preferable.

As synthetic pulp, any kind of synthetic pulp available for a wet paper making process may be used. For example, such a synthetic pulp is disclosed in Japanese Patent Publications No. 8,565 of 1960, No. 19,602 of 1963, No. 2,302 of 1964, No. 10,183 of 1968 and No. 32,458 of 1971, Japanese Laid-Open Patent Publications No. 35,319 of 1972, No. 35,225 of 1972, No. 29,820 of 1975, No. 36,731 of 1975 and No. 40,803 of 1975. In this invention, the synthetic pulp is used in the form of a mixture with natural pulp. The mixture ratio by weight of natural pulp to synthetic pulp should be within the range of 100:0 to 10:90. It is not desirable to use the synthetic pulp alone for making a paper because the paper prepared from synthetic pulp alone changes into a film by heat and pressure of this invention.

The conventional additives such as sizing agents; fixing agents; releasing agents; fillers; dyestuffs; adhesives such as starch, polyvinyl alcohol, carboxy methyl cellulose, sodium aginate and aqueous solutions or emulsions of synthetic resins or polymers; transparentizing agents; transparentizing assistants; and antistatic agents may be used in the process of paper making.

The paper prepared from the pulp suspension having the above described beating degree with the use of a conventional paper machine such as a Fourdrinier paper machine and a cylinder paper machine is moistened by a conventional moistening method such as a coating method with a coater and a spraying method until the moisture content of the paper sheet becomes within the range of 5 to 30%. In the process of moistening paper, various additives such as sizing agents, releasing agents, antistatic agents, transparentizing agents and dyestuffs may be added to the water coated or sprayed.

Thus moistened paper having a moisture content within the range of 5 to 30% is then subjected to heat and pressure with the use of a metal roll having such a finely embossing surface that Rmax is within the range of 5 to 200 microns and a relief peak number is within the range of 1 to 20 per 1 mm. Such embossing degree plays an important role in the development of desired effects. If the value of Rmax is less than 5 microns, the uniformity of coating layer and the desired electrostatic characteristics will not be obtained. If the value of Rmax exceeds 200 microns, the surface of the resultant electrostatic recording material will become so much rough, and accordingly clear images cannot be obtained and the developing agent cannot be accepted uniformly. Therefore, the value of Rmax should be within the range of 5 to 200 microns, preferably 20 to 160 microns.

As described hereinbefore, the paper prepared from lightly beaten pulp has some difficulty in transparentizing the paper compared with that prepared from heavily beaten pulp. However, according to the present invention, such difficulty can be obviated by utilizing the above mentioned embossing metal roll. Especially when the embossing roll having Rmax within the range of 20 to 160 microns is used, a paper having a good balance of quality can be obtained. In addition, it is preferable to use the embossing roll having Rmax, within the range of 20 to 160 microns in the respect of preventing an injury of an elastic roll which is used in combination with the embossing roll for forming a nip. A definition of the term of Rmax is as follows. According to JIS BO601-1970 and JIS BO651-1970, the roll surface is scanned with a stylus having a radius of curvature of 5 microns at the stylus head of under the conditions of a stylus pressure of 0.4 g and a scanning velocity of 0.2 mm/sec. to obtain a chart. A straight line which contacts with three peaks with exception of the heighest peak on the thus obtained chart is drawn as a standard line. A distance from the standard line to the deepest bottom of the curve which exists in a region to which the standard line belongs is defined as Rmax.

The term "relief peak number" refers to the number of peaks per 1 mm of scanning distance on the same chart obtained in the above mentioned measurement of Rmax. Upon the calculation of the relief peak number, extremely low peaks, i.e., those having a height less than 5% of Rmax, should be neglected. Each of Rmax and the relief peak number represents an arithmetic means value of randomly selected respective ten results of measurements. Each of the relief peaks may preferably be sharp. The relief peak number of the embossing roll surface should be within the range of 1 to 20 per 1 mm, preferably 2 to 15 per 1 mm. When the value of the relief peak number is out of this range, it would be impossible to obtain a paper having a uniform transparence and a desired surface roughness.

Among methods for manufacturing the above mentioned embossing roll, an engraving method in which the patterns engraved on a mother roll are reproduced on the surface of the metal roll is the most preferable. The particular uneven surface structures may contribute to enhancing a microscopic linear pressure effect of the roll, a heat transfer effect and a removing effect of air and moisture from the paper layer. Therefore, a uniform transparency can be obtained even on such a paper that has a large interfibrous space therein or an appreciable wire mark or that is inferior in a thermoplasticity.

On the contrary, when an embossing metal roll having a very small surface roughness or Rmax is used, the pressure may be applied to the paper rather in a state of surface pressure from a microscopic viewpoint and accordingly the pressure may not be sufficiently applied to such a part of the paper in which the interfibrous spaces and the wire marks exist. Consequently, a uniform transparency cannot be obtained. The resultant paper has a number of misty opaque spots.

This invention does not intend to limit the material for the embossing metal roll; but metal roll made of cast iron, alloys including nickel and/or chrome, or steel and rolls whose surface is plated with hard chrome are preferably used. The embossing metal roll may also be provided with an internal heating or cooling device therein.

Using an embossing roll which has a particular surface roughness described above, a good matted paper may be obtained even when the moisture content of the paper upon passing through a nip of it is relatively low, i.e., within the range of 5 to 30%, preferably 7 to 27%. Generally, the moisture contained in paper serves as a plasticizer for pulp, a heat transfer medium, or a remover of air contained in the paper to make speedily it transparent. However, it is possible to attain a sufficient transparentization even when the moisture content is relatively low because the particular embossing metal roll of the invention contributes immensely to enhancing the transparentization. Especially, when a synthetic pulp is used for making a paper, the desired results may be obtained in a lower region of moisture content of the paper because the synthetic pulp is mainly composed of thermoplastic polymers and has an extremely low content of equilibrium moisture.

In the industrial practice for preparing the base sheet in the invention, the embossing metal roll is used in an embossing or calendering system. Fundamentally, a single nip embossing machine consisting of an embossing metal roll and an elastic roll which are contact under pressure to each other may be used. In case of a multistack super calendering system having a plurality of nips at least one of chilled rolls may be replaced by the embossing metal roll according to the invention. This invention does not intend to limit the material for the elastic roll and its hardness, but cotton, paper, asbestos, synthetic fibers for fiber roll and hard rubber are desirably used as a material. Referring to the hardness of the elastic roll, one having a shore hardness not less than 70° is preferable.

The temperature of the embossing metal roll should not be limited to a specific range but is determined depending upon the various factors such as moisture content, pulp composition weight of paper and number of nip. When a multiplicity of the embossing rolls is used, each roll may be at the different temperatures. However, it may be generally within the range of 50° to 200° C., preferably 80° to 180° C.

The pressure to be applied on the paper is not limited as well. In case of treating a paper comprising synthetic pulp having a low softening point, the pressure may be relatively low. When the paper comprises a large quantity of natural pulp, a relatively high pressure is preferably applied. Generally, the pressure may be controlled within the range of 20 to 600 kg/cm, preferably 40 to 400 kg/cm.

Thus obtained matted transparent paper has an excellent coating ability and an excellent acceptability of coating composition as a base sheet owing to the finely embossed surface, and a uniformity of coated layer is obtained. Therefore, according to the invention, a wide variety of coater heads may be utilized for making electrostatic recording materails. In additions, the uneven surface structure together with the affect attained by the use of lightly beaten pulp contributes to improving the holding properties, for example, a windability in a finishing process. An electrostatic recording material obtained according to the invention shows excellent paper strength, excellent dimensional stability, excellent acceptability of toner, excellent resolution power, excellent running ability through a recording device, excellent writability in pencil writing and excellent blocking resistance.

To form a dielectric layer of electrostatic recording material, a coating composition comprising dielectric polymeric materials such as homopolymers or copolymers of vinyl monomers such as vinyl chloride, vinyl acetate, vinyl acetal, vinylidene chloride, ethylene, styrene, acrylates and methacrylates; silicone resin; polyurethane; alkyd resin; epoxy resin; chlorinated rubber and etc. dissolved in an organic solvent such as benzene, toluene, xylene, ketones such as methyl ethyl ketone and methyl isobutyl ketone, ethyl acetate and etc. is coated on a base sheet. In such a case, a barrier layer of carboxymethyl cellulose or polyvinyl alcohol is usually formed for the purpose of preventing the penetration of a coating composition into the paper sheet, and of forming a uniform dielectric thin layer. However, this has inevitable disadvantages of decreasing the recording characteristics, increasing the number of processes and high cost.

However, according to the invention, it is not always necessary to form such a barrier layer, because the transparent base sheet of the invention becomes highly resistant to solvents by the repeated application of heat and pressure with use of a combination of embossing roll and elastic roll having a smooth surface.

Since the above organic solvent system coating compositions are disadvantageous in the respects of inflammability, tocixity, handling, and workability, aqueous dispersion system coating compositions have been proposed. However, when an aqueous dispersion system coating composition is applied to the conventional glassine paper and tracing paper, the paper curls owing to its poor dimensional stability against moisture or water, and accordingly it is not practically useful. On the contrary, the transparentized paper according to the invention has an excellent stability to water, therefore, any aqueous dispersion system coating composition can be applied without any trouble to the operation.

As the coating compositions for forming the dielectric layer of the electrostatic recording material according to the invention, both organic solvent systems and an aqueous dispersion systems can be employed. As the embodiments of such coating compositions there may be organic solvent solutions and aqueous dispersions containing polymers such as homopolymers or copolymers of vinyl monomers such as vinyl chloride, vinyl acetate, vinyl acetal, vinylidene chloride ethylene, styrene, butadiene, acrylates, methacrylates, acrylonitrile and chrotonic acid; silicone resin; polyesters; polyurethane; alkyd resins; epoxy resins; chlorinated rubbers and mixtures thereof. However, this invention is not limited to those polymers and it is possible to use the other insulating resins at will. The coating composition may further contain conventional additives, for example, additive for improving a mat-finishing effect, a writability and a printability such as inorganic pigments such as calcium carbonate, barium sulfate, aluminum oxide, natural clays and calcined clays, and fine powder thereof whose surface is treated with various natural and synthetic hydrophobic materials, and fine particles of polymer such as polystyrene; dispersing agents such as phosphates and sodium alkyl naphthalene sulfonate; viscosity controlling agents such as polyvinyl alcohol, carboxymethyl cellulose, gum arabic and gelatin; plasticizers; and dyes, in such amounts that the dielectric property of the dielectric layer is not impaired.

The coating is carried out with use of a conventional coating equipments such as an air knife coater, a roll coater, a blade coater and etc. The amount of coating is within the range of 3 to 20 g/m$^2$, preferably 5 to 10 g/m$^2$, on dry basis, but this is not intended to limit the scope of the invention.

Referring to the electroconductive treating for the base sheet, known electroconductive agents such as inorganic salts; carbon black, fine powder of aluminum, copper nickel etc. and polymeric electrolytes prepared, for example, from vinylbenzyl quaternary ammonium salt, sodium alginate, sodium polyacrylate, sodium polymethylene sulfonate, etc., can be used. It is not necessary to pay any special regard on the application of those electroconductive agents. Those are applied by adding to the pulp composition or by adding to the sizing solution in the process of paper making. Further, those may be applied to the base sheet by coating or size pressing simultaneously with moistening in the process of transparentizing treatment, or by size pressing, impregnating or coating transparentized base sheet therewith.

Referring to the surface resistivity of the treated base sheet, it is preferably within the range of $10^5$ to $10^{11}$ ohm.

The transparency ratio of the resultant electrostatic recording material may be controlled depending on its use. For example, when it is used as a master for duplication, the transparency ratio is generally controlled at more than 50%. The transparency ratio is given by the following formula:

$$\text{Transparency ratio} = 100 - (\text{value of opacity})$$

wherein the value of opacity is measured by Hunter reflectometer according to JIS P-8138.

The invention will be further illustrated by reference to the following examples, however, the invention is not limited to those examples but includes wide variations.

Unless otherwise indicated, parts and % signify parts by weight and % by weight, respectively.

EXAMPLE 1

A paper was made from a pulp suspension having a CSF of 400 cc prepared from 20 parts of a bleached needle-leaved kraft pulp (N) having a CSF of 380 cc and 80 parts of a bleached broad-leaved kraft pulp (L) having a CSF of 450 cc with the use of a Fourdrinier paper machine. The moisture content of the resultant paper was adjusted to 23% by applying water to the sheet with a spray nozzle moistner. Then the sheet was passed through light nips of a fourteen stacks super calendar so that both surfaces of the sheet might be subjected to the treatment with the embossing roll for two times. The fourteen stacks super calender was provided with two embossing rolls plated with hard chromium and having a surface engraved so as to have Rmax of 34.3 microns and a relief peak number of 8 lmm (hereinafter referred to as #800 embossing roll) at the third and sixth position from the bottom so as to be against elastic roll and also having conventional chilled rolls and elastic rolls. The surface temperatures of the third roll and sixth roll were 155° C. and 145° C., respectively. The maximum linear pressure of the final nip was 220 kg/cm and the passing velocity of the paper was 50 m/min.

Then, on the one side surface of the resultant matted transparent paper, an aqueous solution for electroconductive treatment containing polyvinyl benzyl ammonium chloride (Product of Dow Chemical Co., Ltd., ECR-34) and oxidized starch at the ratio of 40:60 on dry basis was coated by the weight of 3 g/m$^2$ on dry basis with the use of an air knife coater. On the other side surface of the paper, a coating composition containing a copolymer of vinyl chloride and vinyl acetate (Product of Denki Kagaku Kogyo Co., Ltd. which is known as Trademark "DENKALAC") and calcium carbonate fine powder at the ratio of 60:40 on dry basis dissolved or dispersed in a mixture solvent of toluene and methyl ethyl ketone (MEK) having a mixing ratio of 1:1 was applied by the weight of 6 g/m$^2$ on dry basis with use of a roll coater to obtain a tranaparent electrostatic recording material.

Control 1-1

An electrostatic recording material was prepared in the same manner as in Example 1 except that the two #800 embossing rolls were replaced with two chilled rolls having a smooth surface, respectively.

Control 1-2

An electrostatic recording material was prepared in the same manner as in Example 1 except that a commercially available tracing paper made from heavily beaten pulp of 40 g/m$^2$ was used as a base sheet.

On the electrostatic recording materials obtained in Example 1 and Controls 1-1 and 1-2, latent images were formed by applying pulse signals of −800 V and 50 micro sec. from a pin matrix electrode having a fine density of 4 lines/mm. Then, a magnetic blush development was carried out with use of dry toner mixed with iron powder to obtain visible images. The reverse side surfaces of those recorded materials were contacted with a hot plate which was heated at 120° C. to melt the toner for fixing.

Various characteristics of the resultant recording materials are shown in Table 1.

In the above Example 1, the electrostatic recording material was obtained without any trouble during the process of preparation, and had a good windability in a finishing process. It further had an excellent recordability to form a clear image and a good suitability for a master for diazo-type capoying.

On the contrary, the base sheet obtained in Control 1-1 was inferior in a suitability for a high speed coating with an air knife coater or a blade coater. Accordingly it was difficult to control the amount of coating composition to be applied on the base sheet. It was also inferior in a windability in the finishing process. In addition, the electrostatic recording material obtained in Control 1-1 was inferior in various functions as shown in Table 1.

The base sheet in Control 1-2 had a poor resistance to water. Accordingly it was remarkably curled, wrinkled and corrugated during the process of electroconductive treatment, so the windability in the finishing process as well as the uniform fixation of toner in the process of fixing treatment with heat was impeded. In addition, the electrostatic recording material obtained in Control 1-2 was inferior in an appearance.

EXAMPLE 2

A synthetic pulp (S) having a CSF of 250 cc was prepared by heating synthetic fibers having 7 denier, a length of 10 mm and a polyvinyl alcohol content of 10% which were obtained by wet spinning from a mixture of a polyvinyl alcohol (hereinafter referred to as PVA) acrylonitrile (hereinafter referred to as AN) graft copolymer in which a weight ratio of PVA/AN was 50/50 with an acrylonitrile-styrene copolymer in which a weight ratio of AN/styrene was 24/76. Thus obtained synthetic pulp (S), a bleached needle-leaved kraft pulp ($N_1$) having a CSF of 580 cc and a bleached broad-leaved kraft pulp ($L_1$) having a CSF of 620 cc were mixed in the proportions shown in Table 1 and formed into papers with a commercial paper machine. The moisture content of the resultant paper was adjusted at the value shown in Table 1.

Then the sheet was passed through six nips of a fourteen stacks super calender so that one side surface of the paper might be subjected to the treatment with the embossing roll for four times and the reverse side surface of the paper might be subjected to the treatment with the embossing roll for one time.

The fourteen stacks super calender is the same one as in Example 1 except that the chilled roll having a smooth surface at the 8th position from the bottom was further replaced with an embossing roll plated with hard chromium and having an engraved surface whose Rmax was 53.7 microns and the relief peak number was 4 per 1 mm (hereinafter referred to as #400 embossing roll). The above treatment was carried out under the conditions that the highest temperature of the embossing roll was at 150° C., the maximum linear pressure of the final nip was 240 kg/cm and the velocity of passing paper was 65 m/min.

Then, one side surface of the resultant transparent papers were subjected to an electroconductive treatment in the same manner as in Example 1. On the other side surface of each, an aqueous dispersion of polymer having a concentration of 30%, which was obtained by mixing 50 parts (on dry basis) of aqueous solution of ammonium salt of copolymer consisting of 30.9 mol % of butadiene, 24.0 mol% of styrene, 20.8 mol% of methyl methacrylate and 24.3 mol% of methacrylic acid, with 50 parts (on dry basis) of aqueous dispersion (weight average particle diameter at 12000 A, the lowest film-forming temperature at 96° C.) which was obtained by suspension polymerization of 92 parts of styrene in an aqueous ammonium solution containing 8 parts of copolymer consisting of 19.0 mol% of styrene, 66.0 mol% of methyl methacrylate and 15.0 mol% of methacrylic acid, was coated with the use of a blade coater to form a dielectric layer about 6 microns in thickness.

Various characteristics of the resultant electrostatic recording materials are shown in Table 1. Each of the resultant electrostatic recording materials had high transparency, good physical strength, good dimensional stability to moisture or water and good windability in the finishing process. The latent images were formed on the electrostatic recording material by applying pulse signals of −700 V and 10 micro sec. with the use of an obliquely scanning recording device having a line density of 6 lines/mm. Then, the latent images were developed with a liquid developer to obtain clear images without any background. The electrostatic recording materials of the invention were recorded by an alternative recording method in which the latent images formed on the surface of available sensitized paper with zinc oxide by an electrophotographic method were transferred to the surface of the electrostatic recording material of the invention by a short circuit method without application of bias. After development of the transferred latent images by magnetic blush development method, a fixing treatment was carried out to obtain clear images. Those recorded materials were very useful for a master for diazo-type coating.

EXAMPLE 3

The same synthetic pulp (S) as used in Example 2, a bleached needle-leaved kraft pulp ($N_1$) having a CSF of 580 cc and a bleached broad-leaved kraft pulp ($L_1$) having a CSF of 620 cc were mixed in the ratio shown in Table 1 and formed into papers with a commercial paper machine. The moisture content of the resultant paper was adjusted at the value shown in Table 1. Then, the paper was passed through 8 nips of a fourteen stacks super calender which was provided with a hard chrome plated 46 mesh emery sand blast roll having an uneven surface whose Rmax was 11 microns and the relief peak number was 8 per 1 mm at the third position from the bottom, so that the paper might be subjected to a treatment with the 46 mesh sand blast roll at the final nip for one time. Upon this treatment, the surface temperature of the roughened-surface roll at the third position was 153° C., the maximum linear pressure of the final nip was 220 kg/cm and the passing velocity of the paper was 60 m/min.

Then, an electrostatic recording material was obtained with the use of the resultant matted transparent paper in the same manner as in Example 2. Various characteristics of the resultant electrostatic recording material are shown in Table 1. The electrostatic recording material obtained in Example 3 was inferior in comparison to those obtained in Examples 1 and 2 in a suitability for coating, writability and blocking resistance, but there was no problem in the practical use of the electrostatic recording material. The recorded material was useful for a master for diazo-type copying.

EXAMPLE 4

Synthetic pulp ($S_1$) having a CSF of 350 cc was prepared by beating synthetic fibers having a PVA content of 20%, 1.2 denier and a length of 6 mm which were made by a wet spinning process from a mixture of a PVA-AN graft copolymer in which the weight ratio of PVA/AN was 50/50 with an AN-methyl acrylate copolymer comprising 95 mol% of AN and 5 mol% of methyl acrylate.

The bleached needle-leaved kraft pulp ($N_2$) having a CSF of 450 cc and the bleached broad-leaved kraft pulp ($L_2$) having a CSF of 500 cc were mixed with the above obtained synthetic pulp ($S_1$) in the proportions shown in Table 2 and formed into papers by the manual papermaking sheet machine manufactured by Toyo Seiki Co., Ltd. The moisture content of the obtained papers were adjusted at the value shown in Table 2. Then, the papers were passed through a two stacks test embossing machine (manufactured by Yuri Roll Co. Ltd.) provided with the #400′ embossing of smaller diameter than that of the #400 embossing roll having the same engraved patterns as those of the #400 embossing roll and provided with an elastic roll under the conditions of the temperature of the embossing roll at 160° C. and the linear pressure at 220 kg/cm for four times in all, reversing the paper upside-down.

Each of the resultant matted transparent paper was subjected to an electroconductive treatment in the same manner as in Example 1 except that a manual coating was carried out instead of the use of air knife coater. Then, a dielectric layer was formed on the thus treated paper in the same manner as in Example 2 except that a manual coating was carried out instead of the use of blade coater. Various characteristics of the resultant electrostatic recording materials are shown in Table 2. The electrostatic recording materials obtained in Example 4 had a good balance in quality.

Control 2

An electrostatic recording material was prepared in the same manner as in Example 4-1 except that a chilled roll having a smooth surface was used instead of the #400′ embossing roll. In the preparation of the electrostatic recording material of this Control, there was such a trouble that uniform coatings of the electroconductive treating solution and of the composition for forming dielectric layer could not be obtained. The electrostatic recording material obtained in Control 2 had a low transparency and an ununiformity of transparency. In addition, it was inferior in various qualities as shown in Table 2.

EXAMPLE 5

Two kinds of commercially available polyvinyl alcohol fibers, VPB 105-1 and VPB 103 (products of Kuraray Co., Ltd.), having one denier and a length of 3 mm were mixed together with in the mixture ratio of VPB 105-1/VPB 103 being 60/40 and then the resultant mixture was dispersed in water to obtain a dispersion of synthetic fibers ($S_2$). Separately, a film of 0,015 mm thickness was prepared by extruding resin pellets consisting of 100 parts of isotactic polypropylene and 30 parts of ethylene-vinyl acetate copolymer and streching the pellets. The obtained film was cut into 10 mm length and then beaten to obtain a synthetic pulp ($S_3$), having CSF of 680 cc. The thus obtained synthetic pulp ($S_2$) and ($S_3$), the bleached needle-leaved kraft pulp ($N_2$) having a CSF of 450 cc and the bleached broad-leaved kraft pulp ($L_2$) having a CSF of 500 cc used in Example 4 were mixed in the proportions shown in Table 2 and then formed into papers with use of a 80 mesh wire. The moisture contents of the papers obtained in Example 5-1 and 5-2 were adjusted at the values shown in Table 2. Then, each paper was passed through a two stacks test embossing machine (manufactured by Yuri Roll Co., Ltd.) provided with an embossing roll having a surface engraved so as to have Rmax of 151 microns and the relief peak number of 2 per Imm (#300 embossing roll) and an elastic roll under the conditions of a temperature at 145° C. and a linear pressure at 220 kg/cm for two times in all, reversing the sheet upside-down. Thereafter, the paper was moistened once again so that the moisture content of the paper might be at the value shown in Table 2 and then passed through the above embossing machine under the conditions of a temperature at 150° C. and a linear pressure at 220 kg/cm for four times in all, reversing the paper upside-down to obtain a matted transparent paper.

The procedures for the treatment of the papers obtained in Example 5-3 and 5-4 were similar to that of Example 5-1 except that an embossing roll having a Rmax of 25.8 microns and the relief peak number of 13 per 1 mm was used instead of the #300 embossing roll.

Each of the resultant matted transparent paper sheet was subjected to an electroconductive treatment in the same manner as in Example 4. Then, a coating composition obtained by mixing an aqueous ammonical aqueous dispersion containing 100 parts of butadiene-styrene (20:80) copolymer and 14 parts of butadiene-methyl methacrylate-methacrylic acid (30:55:15) copolymer, with silicone-coated kaolin at the ratio of 1:1 on dry basis was coated on the paper by the weight of 7 g/m$^2$ to obtain an electrostatic recording material. Various characteristics of the resultant electrostatic recording materials are shown in Table 2. They had a good balance in quality.

Table 1

| | Sheet forming | | | | | | Properties of electrostatic recording material | | | | | |
|---|---|---|---|---|---|---|---|---|---|---|---|---|
| | Pulp Composition on Dry Basis | | | CSF of mixed pulp cc | Weight of sheet g/m² | Moisture content after moistening % | Transparency % | Pencil writability | Blocking resistance | Applicability for copying machine | Uniformity of adhered toner | Recorded images |
| | N or $N_1$ % | L or $L_1$ % | S % | | | | | | | | | |
| Example 1 | $N_{20}$ | $L_{80}$ | — | 400 | 40 | 23 | 61 | good | good | good | good | good |
| Control 1-1 | $N_{20}$ | $L_{80}$ | — | 400 | 40 | 23 | 54 | bad (too flat to write) | bad | not so good | ununiformity | ununiformity |
| Control 1-2 | — | — | — | — | 40 | — | 62 | not so good | not so good | bad | ununiformity | ununiformity |
| Example 2-1 | $N_1$ 50 | $L_1$ 35 | 15 | 460 | 60 | 20 | 64 | good | good | good | good | good |
| Example 2-2 | $N_1$ 15 | $L_1$ 75 | 10 | 500 | 64 | 22 | 61 | good | good | good | good | good |
| Example 2-3 | $N_1$ 30 | $L_1$ 55 | 15 | 470 | 70 | 23 | 59 | good | good | good | good | good |
| Example 2-4 | $N_1$ 30 | $L_1$ 30 | 40 | 350 | 60 | 15 | 67 | good | good | good | good | good |
| Example 3 | $N_1$ 50 | $L_1$ 35 | 15 | 460 | 60 | 22 | 61 | not so good | not so good | good | good | good |

Note:
(1) Transparency (%) = 100 − value of opacity by Hunter reflectometer (JISP8138)
(2) Block ng resistance was determined according to JIS Z-0219.

Table 2

| | Sheet forming | | | | | | | Properties of electrostatic recording material | | | | | |
|---|---|---|---|---|---|---|---|---|---|---|---|---|---|
| | Pulp composition on dry basis | | | CSF of mixed pulp cc | Weight of sheet g/cm² | First moisture content after moistening % | Second moisture content after moistening % | Transparency % | Pencil writability | Blocking resistance | Applicability for copying machine | Uniformity of adhered toner | Recorded images |
| | $N_2$ % | $L_2$ % | $S_1$ or $S_2$ or $S_3$ % | | | | | | | | | | |
| Example 4-1 | 30 | 30 | $S_1$ 40 | 390 | 60 | 14 | — | 60 | good | good | good | good | good |
| Example 4-2 | 20 | — | $S_1$ 80 | 340 | 60 | 10 | — | 69 | good | good | good | good | good |
| Control 2 | 30 | 30 | $S_1$ 40 | 390 | 60 | 14 | — | 54 | bad (too flat to write) | bad | not so good | ununiformity | ununiformity |
| Example 5-1 | 35 | 45 | $S_2$ 20 | 520 | 50 | 17 | 14 | 62 | good | good | good | good | good |
| Example 5-2 | 35 | 25 | $S_2$ 40 | 565 | 50 | 16 | 13 | 70 | good | good | good | good | good |
| Example 5-3 | 35 | 45 | $S_3$ 20 | 515 | 50 | 17 | 14 | 61 | good | good | good | good | good |
| Example 5-4 | 35 | 25 | $S_3$ 40 | 545 | 50 | 15 | 14 | 66 | good | good | good | good | good |

What we claim is:

1. An electrostatic recording material having transparency which comprises an electroconductive base sheet having a dielectric layer thereon, said base sheet being obtained by the steps of preparing a paper from an aqueous suspension of natural pulp having a CSF within the range of 200 to 600 cc, moistening said paper so as to have a moisture content within the range of 5 to 30%, and calendering said moistened paper with the use of a heated embossing metal roll to transparentize said moistened paper and form a finely embossed surface thereon, said embossing metal roll having a peripheral surface engraved so as to have a surface roughness of a Rmax of 20 to 160 microns and a relief peak number of 2 to 15 per 1 mm.

2. An electrostatic recording material as defined in claim 1, wherein said paper is moistened so as to have a moisture content within the range of 7 to 27%.

3. An electrostatic recording material as defined in claim 1, wherein said moistened paper is calendered under pressure within the range of 20 to 600 kg/cm.

4. An electrostatic recording material as defined in claim 3, wherein said moistened paper is calendered under pressure within the range of 40 to 400 kg/cm.

5. An electrostatic recording material as defined in claim 1, wherein the surface temperature of said embossing metal roll is within the range of 50° to 200° C.

6. An electrostatic recording material as defined in claim 5, wherein the surface temperature of said embossing metal roll is within the range of 80° to 180° C.

7. A method for the production of an electrostatic recording meterial comprising forming a dielectric layer on an electroconductive transparent base sheet, said base sheet being obtained by the steps of preparing a paper from an aqueous suspension of natural pulp having a CSF within the range of 200 to 600 cc, moistening said paper so as to have a moisture content within the range of 5 to 30%, and calendering said moistened paper with the use of a heated embossing metal roll to transparentize said moistened paper and form a finely embossed surface thereon, said embossing metal roll having a peripheral surface engraved so as to have a surface roughness of a Rmax of 20 to 160 microns and a relief peak number of 2 to 15 per 1 mm.

8. A method for the production of an electrostatic recording material as defined in claim 7, wherein said paper is moistened so as to have a moisture content within the range of 7 to 27%.

9. A method for the production of an electrostatic recording material as defined in claim 7, wherein said moistened paper is calendered under pressure within the range of 20 to 600 kg/cm.

10. A method for the production of an electrostatic recording material as defined in claim 9, wherein said moistened paper is calendered under pressure within the range of 40 to 400 kg/cm.

11. A method for the production of an electrostatic recording material as defined in claim 7, wherein the surface temperature of said embossing metal roll is within the range of 50° to 200° C.

12. A method for the production of an electrostatic recording material as defined in claim 11, wherein the surface temperature of said embossing metal roll is within the range of 80° to 180° C.

* * * * *